US011549231B2

(12) United States Patent
Eide et al.

(10) Patent No.: US 11,549,231 B2
(45) Date of Patent: Jan. 10, 2023

(54) SUCTION ANCHOR FOR A SUBSEA WELL

(71) Applicant: EQUINOR ENERGY AS, Stavanger (NO)

(72) Inventors: Asle Eide, Sandnes (NO); Morten Sæther, Lillestrøm (NO); Harald Sigurd Nesse, Sandnes (NO); Kristoffer Dahl, Stavanger (NO); Lorents Reinås, Stavanger (NO)

(73) Assignee: EQUINOR ENERGY AS, Stavanger (NO)

( * ) Notice: Subject to any disclaimer, the term of this patent is extended or adjusted under 35 U.S.C. 154(b) by 0 days.

(21) Appl. No.: 16/471,013

(22) PCT Filed: Dec. 22, 2017

(86) PCT No.: PCT/NO2017/050340
§ 371 (c)(1),
(2) Date: Jun. 19, 2019

(87) PCT Pub. No.: WO2018/117862
PCT Pub. Date: Jun. 28, 2018

(65) Prior Publication Data

US 2020/0086952 A1 Mar. 19, 2020

(30) Foreign Application Priority Data

Dec. 23, 2016 (GB) ..... 1622129

(51) Int. Cl.
*E02D 27/52* (2006.01)
*B63B 21/27* (2006.01)
(Continued)

(52) U.S. Cl.
CPC ..... *E02D 27/52* (2013.01); *B63B 21/27* (2013.01); *B63B 21/502* (2013.01); *E02B 17/00* (2013.01);
(Continued)

(58) Field of Classification Search
CPC ..... E21B 43/01; E21B 33/038; E21B 41/08; E21B 41/10; B63B 21/27; B63B 21/502;
(Continued)

(56) References Cited

U.S. PATENT DOCUMENTS 3,307,624 A 3/1967 Lubinski
4,120,362 A 10/1978 Chateau et al.
(Continued)

FOREIGN PATENT DOCUMENTS

CN 103046906 4/2013
NO 20151480 5/2017
(Continued)

OTHER PUBLICATIONS

International Search Report dated Mar. 12, 2018 in International (PCT) Application No. PCT/NO2017/050340.
(Continued)

*Primary Examiner* — Dany E Akakpo
(74) *Attorney, Agent, or Firm* — Wenderoth, Lind & Ponack, L.L.P.

(57) ABSTRACT

A suction anchor for a subsea well is provided. The suction anchor includes a wellhead support structure. The wellhead support structure is at least in part external of the internal volume of the suction anchor.

14 Claims, 2 Drawing Sheets

(51) Int. Cl.

| | |
|---|---|
| ***B63B 21/50*** | (2006.01) |
| ***E02B 17/00*** | (2006.01) |
| ***E21B 41/08*** | (2006.01) |
| ***E21B 33/038*** | (2006.01) |
| ***E02B 17/02*** | (2006.01) |
| ***E02D 27/50*** | (2006.01) |
| ***E21B 41/10*** | (2006.01) |
| ***E02D 23/08*** | (2006.01) |

(52) U.S. Cl.
CPC ..... *E02D 23/08* (2013.01); *E21B 33/038* (2013.01); *E21B 41/08* (2013.01); *E02B 17/02* (2013.01); *E02B 2017/0043* (2013.01); *E02B 2017/0052* (2013.01); *E02B 2017/0078* (2013.01); *E02D 27/50* (2013.01); *E21B 41/10* (2013.01)

(58) Field of Classification Search
CPC ..... E02D 27/52; E02D 23/08; E02D 27/50; E02B 17/00; E02B 17/02; E02B 2017/0043; E02B 2017/0052; E02B 2017/0078
See application file for complete search history.

(56) References Cited

U.S. PATENT DOCUMENTS

| | | | | |
|---|---|---|---|---|
| 4,194,857 | A | 3/1980 | Chateau et al. | |
| 4,257,721 | A | 3/1981 | Haynes | |
| 4,387,771 | A | 6/1983 | Jones | |
| 4,558,744 | A | 12/1985 | Gibb | |
| 4,733,993 | A | 3/1988 | Andreasson | |
| 4,832,124 | A | 5/1989 | Davis | |
| 4,932,811 | A | 6/1990 | Folding | |
| 7,617,652 | B1 | 11/2009 | Flatmoe | |
| 8,950,500 | B2 | 2/2015 | Lieske, II | |
| 9,359,852 | B2 | 6/2016 | Kebadze | |
| 2004/0200620 | A1 | 10/2004 | Ostergaard | |
| 2011/0129304 | A1 | 6/2011 | Wu | |
| 2012/0024535 | A1 | 2/2012 | Lieske, II | |
| 2012/0138307 | A1 | 6/2012 | Berg | |
| 2013/0220206 | A1* | 8/2013 | Mogedal | E21B 41/08 114/296 |
| 2014/0147215 | A1 | 5/2014 | Foo | |
| 2014/0290379 | A1 | 10/2014 | Lee | |
| 2014/0374113 | A1 | 12/2014 | Kebadze | |
| 2014/0374116 | A1 | 12/2014 | Kelso | |
| 2015/0107845 | A1 | 4/2015 | MacMillan | |
| 2015/0240442 | A1 | 8/2015 | Garcia-Valdecasas Bernal | |
| 2015/0259044 | A1 | 9/2015 | Amate Lopez | |
| 2016/0090709 | A1 | 3/2016 | Mohrfeld | |
| 2016/0265297 | A1 | 9/2016 | Lyle | |
| 2016/0272284 | A1 | 9/2016 | Grossmann | |
| 2017/0130547 | A1* | 5/2017 | Bhatnagar | E21B 33/00 |
| 2017/0144732 | A1 | 5/2017 | Van Wijk | |
| 2017/0183835 | A1 | 6/2017 | Lee | |
| 2018/0163518 | A1 | 6/2018 | Reznicek | |
| 2020/0071904 | A1 | 3/2020 | Safaqah | |
| 2020/0277936 | A1 | 9/2020 | Riemers | |

FOREIGN PATENT DOCUMENTS

| | | | | |
|---|---|---|---|---|
| WO | 94/06970 | | 3/1994 | |
| WO | 99/23350 | | 5/1999 | |
| WO | 99/64684 | | 12/1999 | |
| WO | 02/16734 | | 2/2002 | |
| WO | 02/088475 | | 11/2002 | |
| WO | 2004/018826 | | 3/2004 | |
| WO | 2010/068119 | | 6/2010 | |
| WO | 2012/062693 | | 5/2012 | |
| WO | 2013/049194 | | 4/2013 | |
| WO | 2013/050411 | | 4/2013 | |
| WO | 2013/167872 | | 11/2013 | |
| WO | 2015/043856 | | 4/2015 | |
| WO | 2015/054766 | | 4/2015 | |
| WO | 2015/118348 | | 8/2015 | |
| WO | 2016/200271 | | 12/2016 | |
| WO | 2017/155415 | | 9/2017 | |
| WO | 2017/179993 | | 10/2017 | |
| WO | WO-2017179992 | A1 * | 10/2017 | E02D 27/52 |

OTHER PUBLICATIONS

Search Report dated Sep. 1, 2017 in Application No. GB1622129.3.
Search Report dated Jun. 23, 2017 in Application No. GB1622129.3.
Office Action dated May 3, 2021 in corresponding U.S. Appl. No. 16/472,315.
International Search Report dated Mar. 12, 2018 in International Application No. PCT/NO2017/050339, 5 pages.
Written Opinion of the International Searching Authority dated Mar. 5, 2018 in International Application No. PCT/NO2017/050337, 12 pages.

* cited by examiner

SUCTION ANCHOR FOR A SUBSEA WELL

BACKGROUND OF THE INVENTION

1. Technical Field

The invention relates to subsea assemblies that comprise a suction anchor. For example, the suction anchor may be a foundation for a subsea well.

2. Description of the Related Art

It is known to use a suction anchor as the foundation of a subsea well. The suction anchor comprises a skirt and horizontal lid that define a volume in which the pressure can be adjusted relative to the outside environment.

To install the subsea assembly comprising the suction anchor, the suction anchor is lowered onto the seabed and then sucked into the seabed by reducing the pressure inside the skirt. When the suction anchor is a foundation for a subsea well, a well may extend through the suction anchor into the seabed.

SUMMARY OF THE INVENTION

In an aspect of the present invention and disclosure is concerned with an assembly that may allow simplifying a well assembly comprising a suction anchor.

The subsea assembly comprises a suction anchor that may act as a foundation for a subsea well and optionally the associated wellhead equipment and subsea device(s). The subsea device(s) may for example be any known subsea device such as a pump station, a separator, a compressor, a manifold, a control center, a smart manifold, a control hub, power/hydraulic power unit, power equipment, gas compressor module and/or cooler etc.

The suction anchor may comprise an outer skirt and a horizontal top plate that together define a volume in which the pressure can be adjusted relative to the outside environment.

The suction anchor may have a central pipe therethrough that a well may extend through. The central pipe may be (e.g. part of) or receive a low pressure conductor housing of a well.

The central pipe may result in the volume in the suction anchor in which the pressure can be adjusted being an approximately annular volume. The annular volume may be located around the central pipe.

When the suction anchor is on the seabed, the volume may be sealed (this may for example be due to the weight of the suction anchor forcing the bottom of the skirt and (if present) the central pipe into the seabed to seal the internal volume relative to the outside environment). As a result, pressure inside the suction anchor may be reduced so as to suck it into the seabed.

A well may extend through the suction anchor into the sea bed.

In an aspect, the present invention may provide a suction anchor for a subsea well (e.g. the suction anchor may provide or is for providing the foundation of a subsea well), wherein the suction anchor comprises: a skirt; a top plate; a pipe that is for a well to extend through, wherein the skirt, top plate and pipe together define an internal volume in which the pressure can be adjusted relative to the outside environment, and a wellhead support structure, wherein the wellhead support is at least in part external of the internal volume.

Typically, when a suction anchor acts as the foundation for a subsea well, the well extends through the suction anchor and one or more wellhead supports are provided inside the suction anchor's internal volume. At least some of these wellhead supports are provided towards or at the top of the internal volume near the top plate.

It has been realized that there may be several advantages if the wellhead support is at least in part external of the internal volume of the suction anchor.

The wellhead support may be outside/above of the volume inside the suction anchor in which the pressure can be adjusted.

The wellhead support may be integral with the suction anchor (e.g. the top plate and/or the suction skirt). The well head support may be integrally formed with the suction anchor and/or welded to the suction anchor.

The wellhead support may reinforce the suction anchor top plate from above. This means that the suction anchor (i.e. top plate) may be to be able handle a larger implosive differential pressure as the suction anchor is being sucked into the sea bed compared to an otherwise identical arrangement without the external wellhead support.

Thus, the wellhead support may have a dual function of supporting, e.g. laterally and/or axially supporting, the wellhead and reinforcing the top plate of the suction anchor.

When the assembly comprises a wellhead support structure that is external of the internal volume, there may not be any wellhead supports inside the top half of the suction anchor volume connecting the central tube to the suction skirt (other than the top vertical plate). This may reduce the volume of material that has to be sucked into the seabed and/or that may cause friction against the suction anchor being sucked into the sea bed.

The well support structure may provide support for a wellhead of the subsea well assembly and/or provide a surface/interface on which further components (such as a support device (i.e. a support structure) as will be discussed below) can be mounted.

The well support structure may comprise one or more support members. The support members may provide lateral support to the wellhead.

The well support structure may provide axial support to the wellhead.

The well support structure may be arranged so that in use it can be fixed relative to the wellhead. There may be a locking means between the wellhead and the support. This may mean that the wellhead is rigidly connected to the well support structure and hence to the foundation and/or the seabed.

The assembly may be arranged so that the wellhead cannot move laterally and/or axially relative to the wellhead support structure.

The well support structure may support the wellhead from loads due to thermal growth. These may for example be due to thermal growth during production and/or injection operations.

The well support structure may rigidly fix the wellhead to the foundation. As a result, the well support may aid thermal growth arrestment. The well support structure may transfer a thermal growth arrestment load to the foundation and/or the seabed.

The well support structure may allow the loads from the wellhead, e.g. bending moments, lateral loads, axial loads, and/or loads due to the thermal growth etc., to be transferred into the foundation and/or into the sea bed.

The well support members may provide a force couple to support the wellhead, i.e. to help resist bending moments that are applied to the wellhead.

Thus the wellhead support may react and/or support in respect of bending moments. This may be achieved by there being two opposing lateral supporting forces that act as a force couple and thus react an imposed bending moment.

Without the well support members, a force couple may be provided between the top plate of the suction anchor and internal reinforcing members that extend between the suction skirt and the central pipe at or towards the bottom of the suction anchor. Given that the length of the suction anchor between assemblies can vary, the force couple may also vary. By providing well support members on the top plate of the suction anchor, the force couple may instead by provided by these parts. These parts may have a height that is independent of the length of the suction skirt and thus the force couple may be standardized (i.e. it may be a certain value irrespective of the size/geometry of the suction skirt). The height of each well support member may be 0.5 to 1.5 m, e.g. about 1 m. This may be the height irrespective of the size of the suction anchor.

The well support members may each be a member that extends in a radial direction. The well support members may each be a beam, e.g. a plate. The plane of each well support member may be substantially parallel to the axial and a radial direction of the wellhead.

One or more, or each well support member may have a uniform cross sectional characteristics (such as profile or strength). Two or more or each well support member may have an equal size.

One or more, or each well support member may have cross sectional properties and/or sizes that vary along their length (either along part of the length or over the entire length). This variation may be constant along the length or non-constant such as an abrupt change. For example the well support member(s) may have a tapered height. This may taper away from the wellhead.

The well support may connect the wellhead to the top plate and/or suction skirt of the suction anchor. This may allow loads to be transferred from the wellhead through the suction anchor into the sea bed The well support members may be located around the wellhead. The support members may be spaced radially around the wellhead. This may allow the support members to provide support that is fairly evenly distributed around the wellhead.

The well support may comprise an outer frame. The well support members may extend between the outer frame and the wellhead.

The outer frame may have an outer shape that is different to that of the suction anchor perimeter. For example, the suction anchor may be circular and the outer frame may be square.

The outer frame may be larger than that of the suction anchor.

When the subsea well assembly comprises a well support on the suction anchor external of the internal volume, the wellhead may protrude from the top plate of the suction anchor more than an assembly without a well support on the suction anchor.

In other words, the top plate of the suction anchor may effectively be lowered (e.g. the height of the volume in the suction anchor decreased) compared to an arrangement without a well support structure. This may mean that the height of the annular volume in which the pressure can be adjusted may be reduced.

In an arrangement without a well support, due to the loads that are put on a wellhead when equipment is mounted on the wellhead, the wellhead is designed to protrude less from the suction anchor. This is so that the wellhead can be laterally supported by the suction anchor (e.g. by a force couple set up between the top plate (and/or internal wellhead supports near the top plate) and internal reinforcing plates near the bottom of the suction skirt). This means that in an arrangement without a well support most of the wellhead is located within the suction skirt and as a result it may not possible or more difficult to access the wellhead.

When the subsea well assembly comprises a well support on the suction anchor external of the internal, the wellhead may protrude from the top plate of the suction anchor and not be enclosed within the suction skirt. The well support may be an open structure, such as comprising a plurality of radially extending well support members (e.g. plates or beams). This structure may leave parts (e.g. at least a height of 1 metre or at least down to a point below where the high pressure wellhead housing seals to the low pressure wellhead housing) of the outer surface of the top of the wellhead exposed to the outside environment (i.e. not covered by a wellhead support and not within the volume of the suction anchor). This may mean that it is possible/easier to access the wellhead whilst still ensuring that it is laterally supported to the required extent.

The radially extending well support members (e.g. beams) may each be fixed, such as welded, along their length to the top plate of the suction anchor.

The suction anchor may comprise one or more connection points.

The well support may connect to connection points on the suction anchor. The well support may help reinforce and strengthen the connection points of the suction anchor.

The present invention may also provide a method of providing support for a subsea well, wherein the method comprises providing the suction anchor and/or the subsea well assembly as described herein.

The connection points may be attached to the wellhead support structure. For example, when the wellhead support structure comprises radially extending beams the a connection point may be located on one or more or all of the beams of the wellhead support structure.

The present invention may comprise a suction anchor for a subsea assembly (e.g. subsea well assembly), wherein the suction anchor comprises one or more connection points.

The suction anchor may provide the foundation of the assembly.

The connection points may permit other components to be connected to the suction anchor and may permit load transfer from the component connected to the connection point into the suction anchor. When the suction anchor is installed on a sea bed, the connection points may permit load transfer from the component connected to the connection point to the sea bed via at least part of the suction anchor.

The connection points may provide a point for and/or means to allow load transfer from the component connected to the connection point into the suction anchor and thus may be ultimately into the sea floor.

One or more or each connection point may have a predefined, well known and/or standardized attachment profile to allow the load transfer and/or locking of components attached to the connection point.

One or more, or each of the connection points may have a profile that permits load transfer and/or locking of the component that is connected to the connection point.

The connection points may additionally and/or alternatively be used as connection/gripping points for other components that are not associated with the components mounted on the suction anchor.

For example, the connection point may be used (e.g. temporarily) as an anchoring point for a device such as an ROV whilst it is exerting force and/or moving other components. The connection point may thus act as a 'reaction' point.

The connection points may be used as a receiver of loads occurring during installation, such as lifting loads (gravity), as reaction points during the tie in of flow lines and umbilicals and as an anchoring support point for components, such as flowlines and umbilicals, connected to components mounted on the suction anchor.

The connection points may be used as points to hold the suction anchor during installation and/or removal of the suction anchor, i.e. they may be used as lifting points.

Irrespective of the component connected to the connection point, the connection may provide a locking, centralizing, and/or locating function etc.

The connecting (e.g. locking, centralizing, locating (e.g. height adjustment) etc.) may occur as the assembly is installed, e.g. orientation, or it may occur at a desired time after the installation has occurred, e.g. locking by manipulation of a locking mechanism or height adjustments made by a mechanism after installation.

One or more, or each connection point may comprise a hole or socket or a protrusion (such as a pin) to allow the connection to a component. The connection point may have a profile that may be provided by an insert or adapter connected to the connection point to allow the connection such that it permits load transfer and/or locking via the connection point.

The connection point may be designed to have an adjustable height; this may be for example achieved by means of an adjustable insert. The height of the connection points may be independently adjustable. Independent height adjustment features on individual connection points may permit component position and/or inclination to be adjusted.

One or more, or each connection point may be an additional part that protrudes from the main body of the suction anchor to provide an attachment point for parts mounted on the suction anchor (such as a support device as discussed below).

The connection points may be referred to as strong points. One or more, or each connection point may be designed to be load bearing points.

One or more, or each of the connection points may be reinforced points.

One or more, or each of the connection points may be stronger than the adjacent parts of the suction anchor.

One or more, or each connection point may be provided at the outer perimeter (e.g. outer circumference in the case of a cylindrical suction anchor) of the suction anchor. One, more, or each connection point may be attached (e.g. directly) to the suction skirt of the suction anchor.

One or more, or each connection point may be an integral part of the suction anchor. One or more, or each connection point may be integrally formed with the suction anchor or the connection point may be a component that is welded, or otherwise fixed to the suction anchor The suction anchor may have a plurality of (such as four) connection points that one or more components can be connected to.

In the case that the assembly comprises a plurality of connection points, the connection points may be provided at spaced locations around the outer perimeter (e.g. outer circumference in the case of a cylindrical suction anchor) of the suction anchor. The connection points may be substantially equally (including exactly equally) spaced around the perimeter of the suction anchor. For example, in the case of a suction anchor with four connection points, the connection points may be approximately 90 degrees from the adjacent connection points. This may allow load transferred via the connection points to be fairly evenly distributed over the suction anchor.

The connection points may be located relative to each other in a predetermined and/or known arrangement. The connection points may be set distances apart. This means that the interface required for components connecting to the connection points may be known. Components that are to be connected to the connection points may have an appropriately designed interface.

The component attached or to be attached to the one or more connection points may be a component to be mounted on the suction anchor (e.g. the support device and/or the subsea equipment adapter frame). Additionally or alternatively the component attached or to be attached to the one or more or each connection point may be a protective structure. The protective structure may be attached to the connection points when the well assembly is not being used (i.e. during periods of time where the assembly is left alone).

The protective structure may be attached to the connection points when the well assembly is producing or injecting (i.e. during periods of time where the assembly is left alone and actively used according to its intended purpose).

The protective structure may protect the assembly against dropped object impacts and fishing gear impacts for example. The component attached or to be attached to the one or more or each connection point may be an ROV, flow lines or umbilicals for example.

One or more, or each connection point may be provided towards or at the upper surface of the suction anchor (i.e. at or near the height of the top plate). One or more, or each connection point may be at a location that is above the sea bed when the suction anchor is sucked into the seabed.

One or more, or each connection point may comprise a base portion integral with the suction anchor. For example the base portion may be fixed (such as welded) directly to the suction anchor or integrally formed with the suction anchor.

One or more, or each connection point may comprise a connection portion. The connection portion may be the part of the connection point to which the component is attached.

The connection portion and base portion may be distinct parts (yet still may be integral).

One or more or each connection portion may comprise or be arranged to be connected a guide device. For example, the guide device may comprise a protruding member. The protruding member may be a guide post. The guide device may additionally or alternatively comprise a guide funnel.

The subsea assembly may comprise one or more guide devices (e.g. guide posts). These may be part of the connection point or connected to the connection point.

The guide device when attached to the connection point may extend beyond the top of the top plate of the suction anchor.

The connection portion (or another part of the connection point) may act as a receptacle for receiving a part of a component such as a respective guide device (e.g. a protruding member). The guide device when received in the connection point may extend beyond the top horizontal surface of the suction can. Each guide device may provide a means to which the components can be attached, a means for transferring loads (such as lateral loads from the components to the suction anchor), a means for guiding the components into the correct position and orientation on the suction anchor and/or a means to which guide wires can be attached during an installation procedure.

The guide device may be used to orient and position components relative to the wellhead.

When there are a plurality of guide devices (e.g. guide posts), one guide device may be reached first (e.g. it may be longer and/or extend further above the top plate of the suction anchor) than the other guide devices.

For example, when there are a plurality of protruding members (e.g. guide posts), one protruding member may be longer (i.e. extend further above the top plate of the suction anchor) than the other protruding members.

This may aid guiding components onto the top of the subsea assembly. When a component is lowered so as to be received on the top of the suction anchor, the guide devices may be used to guide the components into the correct position. When one guide device is reached first, the orientation of the component may be adjusted when only in contact with that guide device so that the component may be appropriately orientated to align with the other guide devices. For example, in the case of the guide devices being protruding members, the longest protruding member may be used to align the component at one point about which the component can be rotated to line it up with the other protruding members before being lowered onto the other protruding members. This may make it easier to mount components on the subsea assembly.

During installation the component being attached (e.g. the support device and/or the subsea equipment adapter frame) may be guided and received first by the longest (i.e. first reached)) guide device. This may hold the component in a certain position relative to the suction anchor and/or wellhead and the component may then be rotated about the longest guide device before lining up with the other guide devices. Thus, by having one guide device that is longer than the others, installation can be made more reliable and installation time may be reduced.

The subsea assembly may comprise fine alignment device (s); these for example may be locking posts. These fine alignment devices may be used in conjunction with the guide devices (e.g. guide posts) to help position and/or lock the components on the suction anchor foundation. The guide devices may be used to guide the component (e.g. support frame and/or production support) into approximately the correct location and orientation on the suction anchor and the fine alignment device(s) may be used to precisely locate the components and/or lock them to the subsea installation. The fine alignment device(s) may be machined to a high tolerance to ensure that the components are aligned and/or locked in a precise location relative to the suction anchor and/or wellhead.

Additionally and/or alternatively the fine alignment device(s) may be adjustable (for example in a slot along which it can be moved and then fixed). For example the fine alignment device(s) may be adjusted during integration testing of components to be mounted on and/or connected to the suction anchor in order to obtain a final precise location of components during installation.

The guide devices may be used as a coarse guiding means and the fine alignment devices may be used as a fine guiding/aligning means.

The fine guiding/aligning may be in one or several rotational or translational directions.

Whilst the geometry, size etc. of the suction anchor may vary based on factors such as the geology, the connection points may be unchanged by these conditions, i.e. standardized. The connection points may for example be a size and/or location that are independent of the suction anchor, such as independent of the length of the suction anchor. As a result, it may be possible to have a suction anchor that is bespoke (or at least chosen from a few different suction anchor designs) whilst the connection points are standardized. This may allow bespoke or at least different suction anchor designs to connect to the same components.

Thus the present invention may comprise providing a plurality of suction anchors for a subsea assembly of different designs (e.g. different sizes, lengths, and/or geometries) wherein the connection points on each suction anchor are located in the same position relative to the other connection points and/or the connection points are the same size.

Additionally, a suction anchor may be provided with the connection points irrespective of its function. For example, a suction anchor that is for an exploration well assembly may be provided with connection points. This may mean the exploration well assembly can be converted to a production well assembly after a period of time it has been operating as an exploration well. The decision to convert the well from an exploration well to a production well may be made after the well has been operating as an exploration well for a period of time.

A well that can be converted from an exploration well to a production well may be referred to as a keeper well. This process of converting an exploration well to a production well may help to reduce the overall costs of a project.

This is because a new suction anchor does not need to be installed for the production well but instead the exploration well suction anchor can be 'converted' by attaching components (such as components to be mounted on the suction anchor, such as a support device (i.e. a support structure) and/or a subsea equipment adapter frame, and/or components that connect to the suction anchor such as a protection structure and fluid connections such as flowlines and controls umbilicals etc.) onto the suction anchor after it has been decided to convert an exploration well into a production well. The components may be separate dis-connectable parts from the suction anchor.

The conversion may be achieved using the connection members that are already provided on the suction can and because the support device and/or a subsea equipment adapter frame are separately installable components.

The conversion may be decided after the well has been operating as an exploration well, and positive indications of the producible value of the well is verified through the drilling of the exploration well. At that stage the necessary components for the conversion may be manufactured and installed. This may ensure that investments are made on the basis of confirmed information and not estimates.

Typically, an exploration well would be installed to search for suitable/desirable locations to install production wells. Once a suitable location was identified, a production well would be installed. As a result the process would require two wells, an exploration well and then a production well. It has been realized that by providing a suction anchor with connection points, a suction anchor may be used in an exploration well assembly and if it is found that the well has been installed in a location where a production well is desired, the exploration well can be converted to a production well. This may be achieved by connecting components required for a production well assembly to the suction anchor via the connection points.

In another aspect, the present invention may provide a method of converting an exploration well into a production well. The method comprising: providing an exploration well assembly, the exploration well assembly comprising a suction anchor (the suction anchor acting as a well foundation), wherein the suction anchor comprises one or more connection points (that may have one or more of the above described features), converting the exploration well assembly to a production well assembly, wherein converting the exploration well assembly to a production well assembly comprises connecting one or more components to the suction anchor via the one or more connection points.

In this way, it may be possible to provide an exploration well at relatively low cost (as the suction anchor can be kept simple) but provide it with the means to allow it to be converted into a production well. This is achieved by providing connection points on an exploration well to allow components that are required for a production well to be fixed to an exploration well so as to convert it to a production well.

The suction anchor may be the above described suction anchor.

The method may comprise determining whether the exploration well assembly is in a location desired for a production well. If it is determined that the exploration well assembly is in a location desired for a production well, the exploration well may be converted into a production well by connecting one or more components to the suction anchor via the one or more connection points.

No components may be connected to the connection points when the well assembly is being used as an exploration well.

The connection points may be used when the exploration well is being installed, e.g. as lift points.

The connection points may be used as a point to which components mounted on a wellhead e.g. a BOP, can be connected. This may, for example, be during drilling operations. This may be used as a means to minimize loads from the component on the wellhead being transferred into the high pressure well head housing.

The connection points may be used to connect components such as a protection structure to protect the subsea well assembly. This may, for example, be during the time intervals between installation until drilling operations start, and from when drilling operations stop until removal of the well and/or conversion to production well commences and a permanent protection structure may be installed.

The subsea well assembly may comprise a support device. For example, the support device/structure may be a support frame. The component connected to the connection points may be the support device. The support device may also be referred to as equipment support device/structure and/or a protection support.

The equipment support device may be used to support equipment mounted on the suction anchor foundation. This may be any subsea device such as a pump station, a separator, a compressor, a manifold, a control center, a smart manifold, a control hub, power/hydraulic power unit, power equipment, gas compressor module, cooler and/or well production equipment etc.

The equipment support device may not provide any lateral support to a wellhead in the case of a subsea well assembly.

The support device may provide a landing surface for components mounted on a subsea suction anchor. The support device may additionally and/or alternatively be a structure on which on which components may be pre-mounted before the support device is taken subsea. This may provide a convenient means to install components together and in present easily controllable locations relative to each other. The support device may be used to transfer and/or distribute loads into the suction anchor and ultimately into the sea floor.

The support device may be received on the suction anchor (such as on the top plate of the suction anchor).

The support device may extend beyond the outer perimeter of the suction anchor on which it is mounted. Thus, the support device may increase the surface area on which components supported by the suction anchor can be mounted. The support device may thus act as a balcony (i.e. overhang) from the suction anchor.

The support device may also provide receptacles for guide devices (such as guide posts).

The support device may provide support and/or a surface/interface on which further components (such as a subsea equipment adapter frame) can be mounted.

The present invention may comprise providing a plurality of subsea assemblies (e.g. wellhead assemblies), wherein each assembly comprises a suction anchor of different designs and a support device, wherein the support device has the same size (e.g. the same height)/and/or connection points and/or upper interface for each assembly irrespective of the size and/or design of the suction anchor.

The support device, e.g. its outer frame, may be connected to the suction anchor via one or more connection points.

The connection points may provide an interface between a suction anchor foundation and components thereon, such as the support device and subsea equipment adapter frame.

The support device may be a component that is separate from and/or additional to the suction anchor. The suction anchor and the support device may be modular components of the subsea well assembly. Whilst (as discussed above) the suction anchor shape and size may vary between installations, the support device may be standardized. This may allow different installations to have a standardized interface for equipment and other components to be located on.

The support device may be mounted on or arranged to be mounted on the top plate of the suction anchor.

The support device may be connected to the suction anchor via one or more connection points (that may have one or more of the above described features).

The support device may be connected to the suction anchor such that loads may be transferred from a component connected to the support structure into the suction anchor and may be transferred and/or dissipated into the sea bed (i.e. soil or formation).

The support device may be detachably fixed to the suction anchor. Alternatively, the support device may be permanently fixed to the suction anchor, such as by welding.

The support device may be fixed to the suction anchor before it is deployed subsea or the support device may be fixed to the suction anchor when the suction anchor is deployed subsea, such as after it has been sucked into the sea bed.

If an exploration well assembly is being converted to a production well assembly, the method may comprise installing a support device on the suction anchor after a decision has been maded to convert the assembly.

The subsea assembly may comprise a subsea equipment adapter frame. This may be a frame (e.g. standardized frame) on which subsea equipment (e.g. valves and pumps) can be mounted.

The subsea equipment adapter frame may have an interface that is standardized to complement the surface, e.g. support device or suction anchor, on which it is mounted and a bespoke interface to complement equipment that is to be mounted on the subsea assembly. In other words, the adapter frame may act as an interface between a standard support device and a supplier specific connection.

The adapter may act as means to make the equipment and/or components mounted thereon, such as valves, sensors, pump etc., retrievable. This may aid maintenance and/or improve reliability of the assembly.

The suction anchor may comprise one or more well head supports that, in use, provide lateral support to the wellhead extending through the suction anchor. Wellhead supports may be located within the internal volume of the suction anchor. The wellhead supports may be on top of the top plate of the suction anchor external to the internal volume of the suction anchor. In this case, the support device may be received on the wellhead supports. Alternatively the support device may have an interface that complements the interface of the wellhead supports such that the support device is still received on the top plate of the suction between the wellhead supports.

The support device may thus be in a plane above the wellhead supports, in line with the plane of the wellhead supports or even below the plane of the wellhead supports.

The planes of the support device and the suction anchor top may be approximately at the same inclination. This may be achieved by adjusting the plane of the support device connected to the connection points until it approximately matches the inclination of the top plate of the suction anchor.

The subsea assembly may comprise a suction anchor, a support frame and a subsea equipment adapter frame. These components (if present) may be separate components. These components may be installed and/or uninstalled separately. For example, first the suction anchor may be installed and sucked into the sea bed, next the support device may be installed onto the suction anchor and fixed thereto, e.g. via one or more of the connection points, next if present in the assembly, the subsea equipment adapter frame may be mounted onto and/or fixed to the support frame. The reverse may be done to uninstall a wellhead assembly.

The present invention may provide a method of installing a subsea assembly, the subsea assembly comprising a suction anchor and a support device, wherein the suction anchor is installed on a sea bed and then (e.g. after the suction anchor has been sucked into the sea bed and/or other components (such as a well head in the case of a subsea well assembly) have been installed) the support device is mounted on and/or fixed to the suction anchor.

The present invention may provide a method of uninstalling a subsea assembly, the subsea assembly comprising a suction anchor and a support device, wherein the support device is dismounted from and/or unfixed from the suction anchor, and then the suction anchor is uninstalled from the sea bed. Final removal of the assembly may be made using the retrievability of assembly components to ease, simplify and reduce cost of the removal operations.

By providing a suction anchor, support device and subsea equipment adapter frame as separate (e.g. modular) components that may be installed and/or uninstalled separately, the assembly may be more flexible. For example, it may be possible with this assembly to convert an exploration well to a production well and/or provide different subsea equipment adapter frame depending on the equipment being used with the well.

The suction anchor, support device and/or subsea equipment adapter frame may be detachably fixed to each other. Alternatively, these components may be permanently fixed to each other, such as by welding.

An exploration well may be converted to a production well by attaching a support frame and/or a subsea equipment adapter frame (e.g. production support) onto the suction anchor. Thereafter production equipment may be mounted on the subsea well assembly to allow the well to function as a production well rather than an exploration well.

Alternatively, the suction anchor, support frame and/or subsea equipment adapter frame may be fixed together before the assembly is deployed subsea.

The support frame and/or subsea equipment adapter frame may be standardized and have a size, geometry and/or interface (e.g. the interface facing away from and/or towards the suction anchor) that is independent (i.e. the same irrespective) of the size of the suction anchor (that may vary e.g. due to the geology). This may be possible if the suction anchor has standardized connection points as discussed above.

Subsea equipment, e.g. a Christmas tree or a BOP, may be mounted on the subsea assembly, e.g. on the wellhead.

The support frame and the subsea equipment adapter frame may have a central opening to allow them to be installed and/or retrieved over subsea equipment such as a BOP and/or a Christmas tree if they are already mounted on the wellhead.

If the assembly comprises a plurality of suction anchors, e.g. two, the support frame and/or subsea equipment adapter frame may extend over at least part of each suction anchor and/or be connected to at least one connection point on each suction anchor.

In the case that the subsea installation comprises two or more suction cans, the support frame may be used to ensure that there is a certain pre-set distance between adjacent suction cans. A single support frame and/or subsea equipment adapter frame may be used for a plurality of suction anchors. \

BRIEF DESCRIPTION OF THE DRAWINGS

Certain preferred embodiments of the present invention will now be described by way of example only with reference to the accompanying drawings, in which.

DETAILED DESCRIPTION OF THE INVENTION

Figure 1:
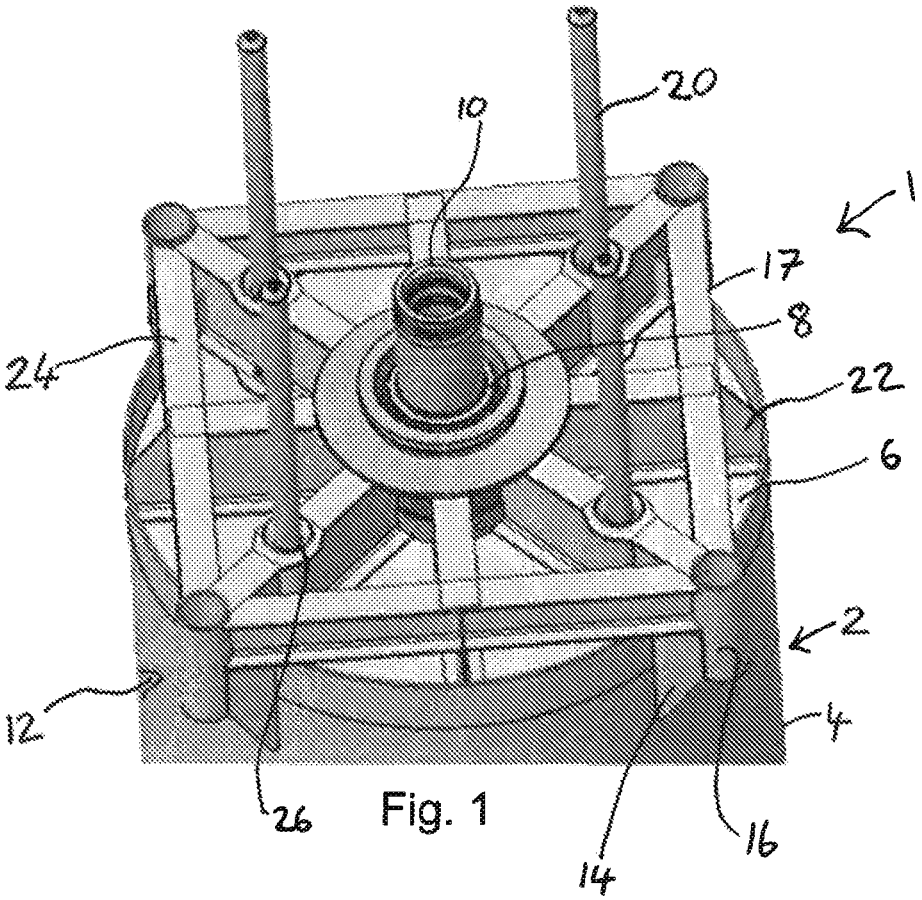
FIG. 1 is a perspective view of the top of a first subsea well assembly.

FIG. 1 shows part of a subsea well assembly 1. The subsea well assembly 1 comprises a suction anchor 2. The suction anchor 2 comprises an outer suction skirt 4 around a central tube and a top plate 6 connecting the outer suction skirt to the central tube to form an internal volume inside the suction anchor 2 that is a sealed volume when the suction anchor 2 is on the sea floor and has penetrated the sea floor slightly. This penetration may be due to its own weight or due to putting extra downward force on the top of the suction anchor 2 when it is resting on the seafloor.

The suction anchor 2 may be sucked into the sea floor by reducing the pressure inside the suction anchor 2 to thereby provide a subsea well foundation in the seabed.

The central tube may be or receive a low pressure wellhead housing 8 in which is received a high pressure wellhead housing 10.

Figure 2:
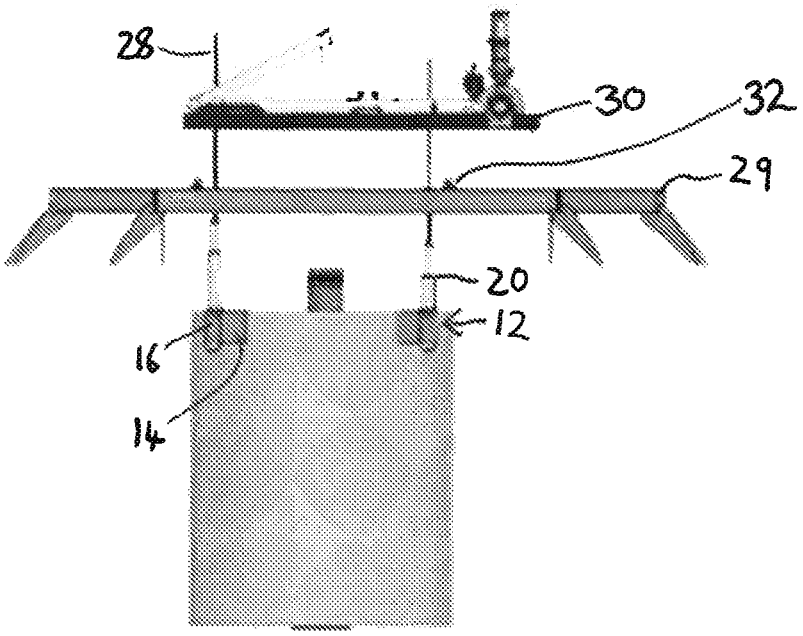
FIG. 2 is a side view of a second subsea well assembly.

The suction anchor 2 may comprise a plurality (there are four in the example of FIG. 1) of integral connection/strong points 12. These connection points 12 are stronger than the adjacent parts of the suction anchor 2 and provide a strong point for components to be connected to the suction anchor 2 such that load can be transmitted into the suction anchor 2 and thus into the sea floor. The connection points 12 are located equally spaced around the top of the suction skirt 4 of the suction anchor 2. The connection points 12 are integral (e.g. welded or integrally formed) with the suction anchor 2. Each connection point has a base portion 14 and a connection portion 16. The base portion 14 is fixed to the suction anchor 2 (e.g. on the suction skirt). The connection portion 16 protrudes from the top of the suction anchor 2 and provides a part to which other components such as a support frame can be connected. The connection portion 16 may also comprise a receptacle for receiving a guiding device such as guide post 20 as shown in FIG. 2.

The receptacle may have a standard interface to allow it to be locked to the component it receives and for loads to be transferred from the component into the connection points.

The assembly 1 in FIG. 1 shows a wellhead support 17 mounted on the suction anchor 2. The wellhead support 17 is external of the internal volume of the suction anchor 2. The wellhead support 17 may be connected to the suction anchor 2 via the connection points 12 and/or be directly attached to the top plate 6. The wellhead support 17 may for example be welded to the connection points 12 and/or the top plate 6. The wellhead support 17 may also support the connection points 12.

The wellhead support 17 may rest on the top plate 6 of the suction anchor 2.

The wellhead support 17 may have the dual function of supporting the wellhead and reinforcing the top plate 6 of the suction anchor 2.

The wellhead support 17 may have a plurality of wellhead support members 22 (in this case eight). The wellhead support members 22 may provide lateral support to the wellhead 8 and allow the transfer loads from the wellhead 8 into the suction anchor 2. The wellhead support members 22 each comprise vertical plates (e.g. I-beams) that are spaced around the circumference of the wellhead 8 outside of the internal volume of the suction anchor. This allows the wellhead support members to provide lateral support to the wellhead 8 distributed around its circumference whilst leaving parts of the wellhead 8 exposed for wellhead interventions. The wellhead support members 22 may be connected via an outer frame 24. Thus the wellhead support 17 may comprise the wellhead support members 22 and the outer frame 24. The outer frame 24 may rigidly connect the wellhead support members 22 and be used to connect the wellhead support 17 to the suction anchor 2 via the connection points 12.

The well support 17 may also comprise one or more receptacles 26 for receiving guide devices 20 (e.g. guide posts). These protruding members 20 may provide a means to which components can be attached, a means for transferring loads (such as lateral loads from components mounted on the assembly 1 to the suction anchor 2), a means for guiding the components into the correct position and orientation on the suction anchor 2 and/or a means to which guide wires 28 can be attached during an installation procedure (as shown for example in FIG. 2).

The well support 17 may be integral with the suction anchor or a separate modular component from the suction anchor 2 and may be installed separately from the suction anchor 2.

The well support 17 may provide a surface on which components mounted on the subsea assembly 1 may rest. For example, equipment support device 29 or subsea equipment adapter frame 30 may be located on the wellhead support 17. The subsea equipment adapter frame 30 may be a separate modular component from the suction anchor 2 and the well support 17 and/or the equipment support device 29 and may be installed separately from the suction anchor 2 and equipment support device 29.

A suction anchor 2 with connection points 12 may be installed and used as an exploration well. If it is desired to convert the suction anchor 2 from an exploration well to a production well this may be possible by using the connection points 12 to connect equipment support device 29 and subsea equipment adapter frame 30 to the suction anchor 1.

To install the equipment support device 29 and/or the subsea equipment adapter frame 30 on a preinstalled suction anchor 2, guide posts 20 may be installed on/in the connection portions 16 of the connection points 12 (see for example FIG. 2). Guide wires 28 may be connected to the guide posts 20. The guide wires 28 may be passed through apertures in the equipment support device 29 and subsea equipment adapter frame 30 and used to guide these components into roughly the correct location above the wellhead and onto the guide posts 20.

Figure 3:
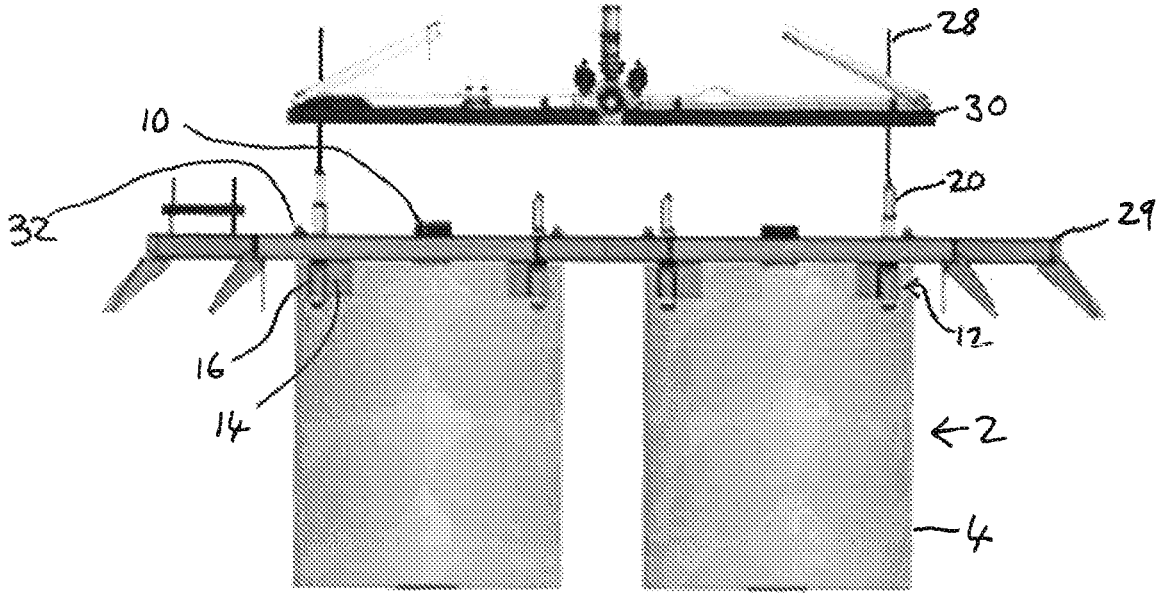
FIG. 3 is a side view of a third subsea well assembly.

As shown in FIGS. 2 and 3, one of the guide posts 20 may be longer than the other guide posts 20. This is so that this longer guide post 20 is received first in an aperture in the component being mounted and at that point provides a point about which the component can be rotated to get it in the correct location to be received by the other guide posts 20. This may make the installation easier as first the component can be translated to align an aperture with the longer guide post 20 and then rotated to align the other apertures with the other guide posts 20.

Once the component (e.g. the equipment support device 29 and/or the subsea equipment adapter frame 30) being mounted has been roughly aligned relative to the wellhead 10 using the guide posts 20, the component may be precisely aligned using one or more fine alignment members 32. These fine alignment members 32 may be used in conjunction with the protruding members (e.g. guide posts 20) to help position and/or lock the components on the suction anchor foundation 2. The protruding members 20 may be used to guide the component (e.g. equipment support device 29 and/or subsea equipment adapter frame 30) into approximately the correct location and orientation on the suction anchor 2 and the fine alignment members 32 may be used to precisely locate the components and lock them to the subsea installation 1. The fine alignment members 32 may be machined to a high tolerance to ensure that the components are located and/or locked in a precise location relative to the suction anchor 2 and/or wellhead 10. In other words, the guide posts 20 may be used as a coarse guiding means and the fine alignment members 32 may be used as a fine guiding/aligning means.

FIG. 3 shows a subsea well assembly 1 that comprises two suction anchors 2. The assembly comprises one equipment support device 29 that extends over both suction anchors 2 and one subsea equipment adapter frame 30 that is supported by both suction anchors 2. Other than the fact that the arrangement comprises two suction anchors 2 rather than one, the assembly is otherwise the same as the examples shown in FIGS. 1 and 2.

In the assemblies of FIGS. 2 and 3, the wellhead supports are not shown.

Figure 4:
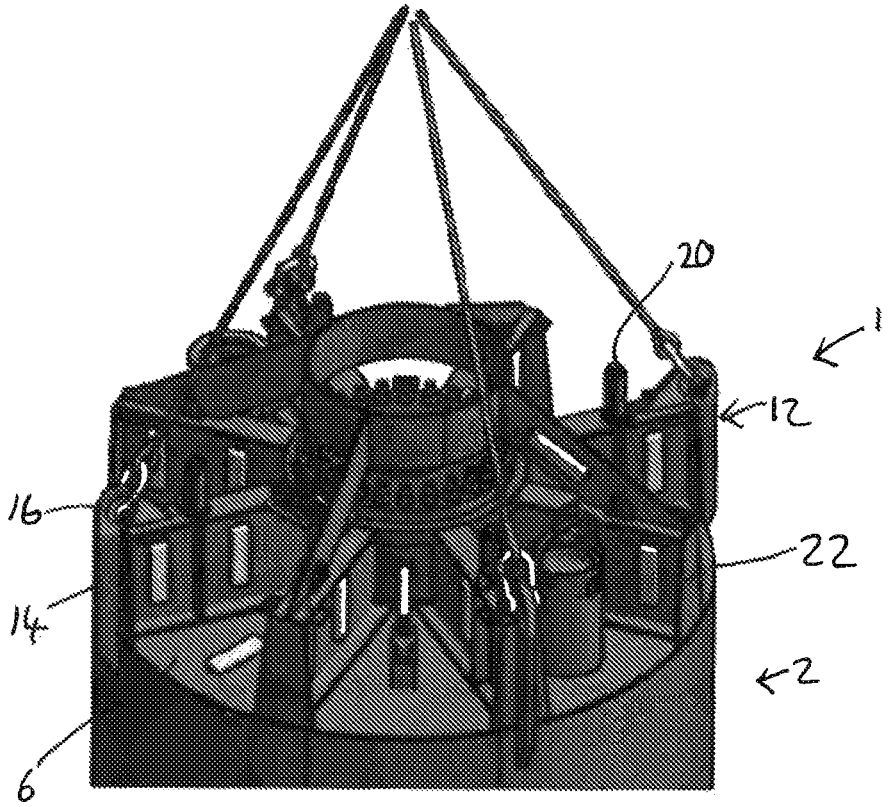
FIG. 4 is a perspective view of a fourth subsea well assembly.

FIG. 4 shows another subsea well assembly 1. This is broadly equivalent to the assembly 1 shown in FIG. 1 except the well support members 22 are not connected by an outer frame. The wellhead support members 22 are integral with the top plate 6 of of the suction anchor 2 such that they can have the dual function of laterally supporting the wellhead and strengthening the suction anchor 2.

The connection points 12 are mounted on/fixed to/part of the well support members 22. In this figure the connection points 16 are being shown as being used as lift points during installation or uninstallation of the assembly 1. The connection points 12 may be connected to other components, such as wellhead load relief connectors, during other phases of operation.

The following clauses set out features of the invention which may not presently be claimed but which may form the basis for amendments or future divisional applications.

1. A suction anchor for a subsea assembly, wherein the suction anchor comprises connection points, wherein the connection points permit other components to be connected to the suction anchor and permit loads to transfer from the component connected to the connection points into the suction anchor.
2. A suction anchor according to clause 1, wherein the connection points are additional parts that protrude from the skirt of the suction anchor to provide an attachment point for components to be mounted on the suction anchor.
3. A suction anchor according to clause 1 or 2, wherein the connection points are stronger than the adjacent parts of the suction anchor.
4. A suction anchor according to clause 1, 2 or 3, wherein one or more of the connection points is provided at the outer perimeter of the suction anchor
5. A suction anchor according to any preceding clause, wherein one or more of the connection points extends beyond the top of the suction anchor.
6. A suction anchor according to any preceding clause, wherein the connection points are provided at approximately equally spaced locations around the outer perimeter of the suction anchor.
7. A suction anchor according to any preceding clause, wherein one or more of the connection points is integral with the suction anchor.
8. A suction anchor according to any preceding clause, wherein one or more of the connection points has a profile that permits load transfer and/or locking of the component that is connected to the connection point.
9. A suction anchor according to any preceding clause, wherein each connection point comprises a base portion integral with the suction anchor and a connection portion to which a component can be attached.
10. A suction anchor according to any preceding clause, wherein the suction anchor is for providing a foundation for a subsea well assembly.
11. A subsea assembly comprising the suction anchor of any preceding clause.
12. A subsea assembly according to clause 11, wherein one or more connection point is connected to a guide device
13. A subsea assembly according to clause 12, wherein one or more of the guide devices provides a means to which the components can be attached, a means for transferring loads to the suction anchor, a means for guiding the components into the correct position and orientation on the suction anchor, and/or a means to which guide wires can be attached during an installation procedure.
14. A subsea assembly according to clause 12 or 13, wherein one guide device protrudes further from the suction anchor than the other guide devices.
15. A subsea assembly according to clause 11, 12 or 13, wherein the subsea foundation comprises fine alignment devices, wherein the guide devices are used to guide a component into approximately the correct location and orientation on the suction anchor and the fine alignment devices are used to more precisely locate the component and/or lock it to the subsea assembly.
16. A subsea assembly according to any of clauses 11 to 15, wherein the subsea assembly is a subsea well assembly.
17. A method, wherein the method comprises providing the suction anchor or subsea assembly of any preceding clause.
18. A method according to clause 16, wherein the method comprises providing a plurality of suction anchors of different designs wherein the connection points on each suction anchor are located in the same position relative to the other connection points and/or the connection points are the same size between each of the suction anchors.
19. A method of converting an exploration well into a production well, the method comprising:
    providing a subsea well assembly, the well assembly comprising a suction anchor, wherein the suction anchor comprises one or more connection points,
    using the subsea well assembly as an exploration well assembly; and
    converting the exploration well assembly to a production well assembly, wherein converting the exploration well assembly to a production well assembly comprises connecting one or more components to the suction anchor via the one or more connection points.
20. A method according to clause 19, wherein no components are connected to the connection points when the well assembly is being used as an exploration well.
21. A method according to clause 19 or 20, wherein the one or more components comprises a support device and/or a subsea equipment adapter frame and wherein converting the exploration well assembly to a production well assembly comprises installing the support device and/or the subsea equipment adapter frame on the suction anchor.
22. A subsea assembly comprising:
    a suction anchor,
    a support device; and
    a subsea equipment adapter frame, wherein the suction anchor, support device and subsea equipment adapter frame are separate modular components that can be installed or uninstalled separately.
23. A subsea assembly according to clause 22, wherein the suction anchor is the suction anchor of any of clauses 1 to 10 and/or wherein the subsea assembly is the subsea assembly of any of clauses 11 to 16.
24. A subsea assembly according to clause 23, wherein the one or more components connected to the connection points is the support device and/or the subsea equipment adapter frame.

25. A method of installing a subsea assembly, the subsea assembly comprising a suction anchor and a support device, wherein the suction anchor is installed on a seabed and then the support device is mounted on the suction anchor.

26. A method of installing a subsea assembly according to clause 25, wherein the subsea assembly is the subsea assembly of any of clauses 22 to 24.

27. A method of uninstalling a subsea assembly, the subsea assembly comprising a suction anchor and a support device, wherein the support device is dismounted from the suction anchor and retrieved before the suction anchor is uninstalled from the seabed.

28. A method of uninstalling a subsea assembly according to clause 27, wherein the subsea assembly is the subsea assembly of any of clauses 22 to 24.

29. A suction anchor for a subsea well, wherein the suction anchor comprises:

a skirt;

a top plate;

a pipe that is for a well to extend through, wherein the skirt, top plate and pipe together define an internal volume in which the pressure can be adjusted relative to the outside environment, and a wellhead support structure, wherein the wellhead support is at least in part external of the internal volume.

30. A suction anchor according to clause 29, wherein the wellhead support structure provides lateral support to the wellhead.

31. A suction anchor according to clauses 29 or 30, wherein the wellhead support structure reinforces the top plate.

32. A suction anchor according to clause 29, 30 or 31, wherein the wellhead support structure comprises a plurality of radially extending members that extend in a radial direction from the wellhead.

33. A subsea well assembly, wherein the assembly comprises:

a suction anchor according to any of clauses 29 to 32, and a well head that extends through the top plate of the suction anchor, wherein the wellhead protrudes from a top plate of the suction anchor and is not enclosed within the suction skirt from the top of the wellhead at least down to a point below where a high pressure wellhead housing of the wellhead seals to a low pressure wellhead housing.

The invention claimed is:

1. A suction anchor for a subsea well, wherein the suction anchor comprises:

a skirt;

a top plate;

a pipe that is for a well to extend through, wherein the skirt, top plate and pipe together define an internal volume in which pressure can be adjusted relative to the outside environment; and a wellhead support structure, wherein the wellhead support structure is at least in part external of the internal volume, wherein the wellhead support structure comprises a plurality of radially extending well support members, wherein the radially extending well support members are each fixed along their length to the top plate of the suction anchor such that the wellhead support structure has a dual function of supporting a wellhead and reinforcing the top plate, wherein the wellhead support structure supports the wellhead laterally or axially, and reinforces the top plate directly from above so that the top plate resists implosion.

2. The suction anchor according to claim 1, wherein the radially extending support members are each welded along their length to the top plate.

3. The suction anchor according to claim 1, further comprising connection points, wherein the connection points permit other components to be connected to the suction anchor and permit loads to transfer from the component connected to the connection points into the suction anchor.

4. The suction anchor according to claim 3, wherein the connection points are each attached to the wellhead support structure.

5. The suction anchor according to claim 1, wherein the wellhead support structure is for laterally supporting the wellhead.

6. The suction anchor according to claim 1, wherein the wellhead support structure is for axially supporting the wellhead.

7. The suction anchor according to claim 1, wherein the wellhead support structure is for resisting bending moments applied to the wellhead.

8. A subsea well assembly, wherein the assembly comprises:

a suction anchor according to claim 1, and a wellhead that extends through the top plate of the suction anchor, wherein the wellhead protrudes from the top plate of the suction anchor and is not enclosed within the suction skirt from the top of the wellhead at least down to a point below where a high pressure wellhead housing of the wellhead seals to a low pressure wellhead housing.

9. The subsea well assembly according to claim 8, wherein the wellhead support structure is connected to the wellhead.

10. A method of providing support for a subsea well, wherein the method comprises:

providing a suction anchor including a skirt, a top plate, a pipe that is for a well to extend through, wherein the skirt, top plate and pipe together define an internal volume in which the pressure can be adjusted relative to the outside environment, and a wellhead support structure, wherein the wellhead support is at least in part external of an internal volume of the suction anchor, and the wellhead support structure comprises a plurality of radially extending well support members, wherein the radially extending well support members are each fixed along their length to the top plate of the suction anchor such that the wellhead support structure has the dual function of supporting a wellhead laterally or axially and reinforcing the top plate directly from above so that the top plate resists implosion; and positioning the wellhead so as to extend through the top plate of the suction anchor, wherein the wellhead protrudes from the top plate of the suction anchor and is not enclosed within the suction skirt from the top of the wellhead at least down to a point below where a high pressure wellhead housing of the wellhead seals to a low pressure wellhead housing.

11. The method according to claim 10, wherein the method comprises laterally supporting the wellhead with the wellhead support structure.

12. The method according to claim 10, wherein the method comprises axially supporting the wellhead with the wellhead support structure.

13. The method according to claim 10, wherein the wellhead support structure is used to arrest thermal growth of the wellhead.

14. The method according to claim 10, wherein the wellhead support structure is used to resist bending moments applied to the wellhead.

* * * * *